US009815651B2

(12) United States Patent
Peccetti

(10) Patent No.: US 9,815,651 B2
(45) Date of Patent: Nov. 14, 2017

(54) HOLDING AND SUPPORTING GROUP OF A WINDING SPINDLE IN A PLASTIC FILM WINDING MACHINE

(71) Applicant: COLINES S.P.A., Novara (IT)

(72) Inventor: Eraldo Peccetti, Novara (IT)

(73) Assignee: COLINES S.P.A., Novara (IT)

( * ) Notice: Subject to any disclaimer, the term of this patent is extended or adjusted under 35 U.S.C. 154(b) by 90 days.

(21) Appl. No.: 14/917,377

(22) PCT Filed: Sep. 17, 2014

(86) PCT No.: PCT/EP2014/002503
§ 371 (c)(1),
(2) Date: Mar. 8, 2016

(87) PCT Pub. No.: WO2015/043724
PCT Pub. Date: Apr. 2, 2015

(65) Prior Publication Data

US 2016/0214819 A1 Jul. 28, 2016

(30) Foreign Application Priority Data

Sep. 25, 2013 (IT) ..... MI2013A1574

(51) Int. Cl.
*B65H 18/26* (2006.01)
*B65H 19/22* (2006.01)

(52) U.S. Cl.
CPC ..... *B65H 19/2207* (2013.01); *B65H 2301/41362* (2013.01)

(58) Field of Classification Search
CPC .. B65H 18/26; B65H 19/20; B65H 2511/142; B65H 2220/04
See application file for complete search history.

(56) References Cited

U.S. PATENT DOCUMENTS 3,670,979 A 6/1972 Seay et al.
8,910,897 B2 * 12/2014 Singer ..... B65H 18/021 242/533
8,915,461 B2 * 12/2014 Singer ..... B65H 18/021 242/533
9,027,870 B2 * 5/2015 Singer ..... B65H 18/021 242/533

FOREIGN PATENT DOCUMENTS

EP 0857679 A2 8/1998
EP 2039634 A1 3/2009

* cited by examiner

*Primary Examiner* — Sang Kim
(74) *Attorney, Agent, or Firm* — Themis Law

(57) ABSTRACT

A holding and supporting group of a winding spindle in a machine for winding plastic film onto spools includes a winding reel positioned between two uprights, wherein a first upright carries a rotating plate which cantilever-supports three spindles and a central shaft, wherein the central shaft is supported at the other end by the second upright, wherein, in correspondence with a free end of the central shaft, there is a star-shaped plate with three supporting arms for each free end of the three spindles through a respective toggle lever mechanism driven by an actuator carried on a lever articulated with respect to the star-shaped plate, and in turn caused to oscillate between an operative blocking position of the respective spindle and a rest position for releasing the respective spindle by an additional actuator.

6 Claims, 7 Drawing Sheets

C
F
25
27
28
26
22
21
16, 17, 18
23
29
24
20
30

HOLDING AND SUPPORTING GROUP OF A WINDING SPINDLE IN A PLASTIC FILM WINDING MACHINE

The present invention relates to a holding and supporting group of a winding spindle in a machine for winding plastic film onto spools.

Various supporting systems of the spindle present in each winding reel are currently used in the field of machines for winding plastic film onto spools.

This support is generally effected between a tip and tailstock which are axially moved towards or away from each other in order to axially block or release the spindle for removing the spool(s).

This technology currently used creates a first problem of time loss for moving the tip and tailstock towards and away from each other for loading the cores and removing the wound spools.

A second problem relates to the vibrations created due to the end supporting system between the tip and tailstock that does not perfectly clasp the spindle and does not guarantee a stabile axial blockage.

Another particular problem relates to the possible flexions that arise in an arrangement of the spindle between facing front end supports.

Furthermore, in certain types of these winding machines, spools can be wound onto cores having a diameter of 2 or 3 inches defined with respect to common use as "manual" and "automatic".

Spools for "manual" use must be produced with a relatively short length of wound material and consequently in order to reach high production rates, a spool-change cycle must be effected in short times. To produce 150 ml spools at 600 m/min, for example, 4 changes per minute are required, and therefore a change every 15 seconds.

This does not allow an online production of spools having an extremely reduced diameter and weight at high rates, as desired.

Furthermore, the necessity of producing very thin films (from 6 μm to 12 μm indicatively) has led to the study and creation of various expedients suitable for eliminating the basic problems that arise during the winding of such thin films.

The necessity of effecting extremely rapid change cycles makes it necessary, for example, to extract the spools produced from the reel without moving the same. This operation can evidently only be effected by freeing an end of the reel itself in order to extract the spools produced, and also insert new cardboard cores.

A general objective of the present invention is to solve the drawbacks of the known art indicated above in an extremely simple, economical and particularly functional manner.

A further objective of the present invention is to provide a holding and supporting group of a winding spindle in a machine for winding plastic film onto spools, which reduces the core-substitution and spool-extraction times.

Another objective of the present invention is to provide a holding and supporting group of a winding spindle in a machine for winding plastic film onto spools, which eliminates the vibrations of tip-tailstock end supporting groups.

Yet another objective of the present invention is to provide a holding and supporting group of a winding spindle in a machine for winding plastic film onto spools, which ensures a secure support and blockage in the spindle, even with the possibility of its rapid removal.

A further objective of the present invention is to provide a holding and supporting group of a winding spindle in a machine for winding plastic film onto spools, which eliminates possible flexions of the spindle positioned between its supports.

In view of the above objectives, according to the present invention, a holding and supporting group of a winding spindle in a machine for winding plastic film onto spools has been conceived, having the characteristics specified in the enclosed claims.

The structural and functional characteristics of the present invention and its advantages with respect to the known art will appear even more evident from the following description, referring to the enclosed drawings, which show an embodiment of a holding and supporting group of a winding spindle produced according to the present invention.

Figure 3A:
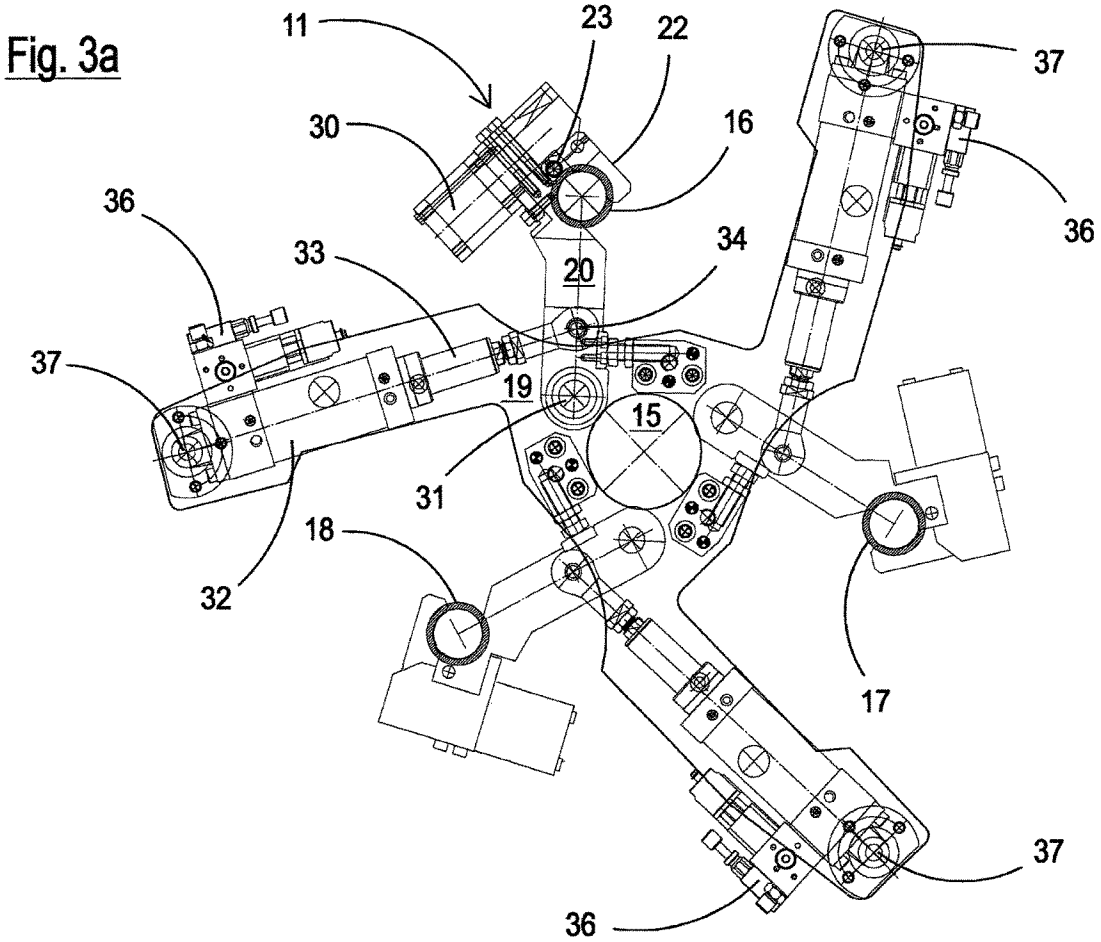
Figure 3B:
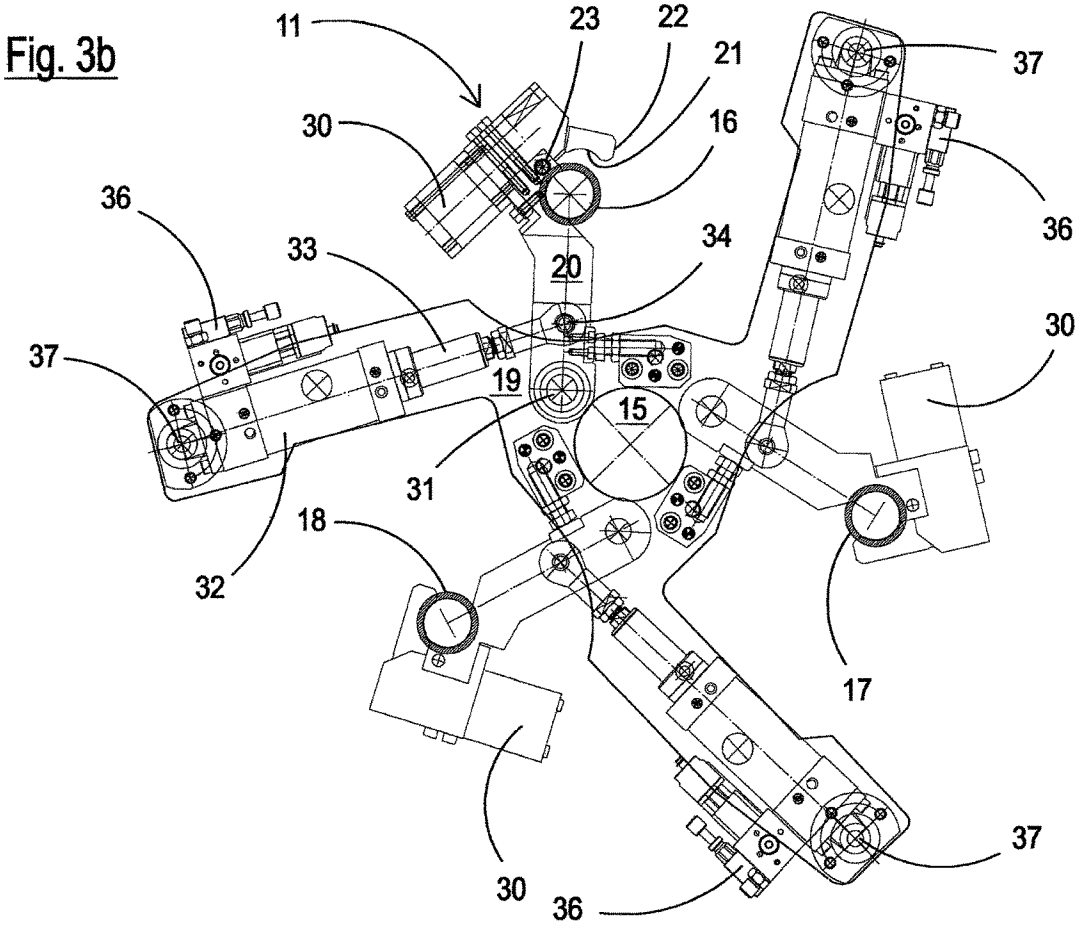
Figure 3C:
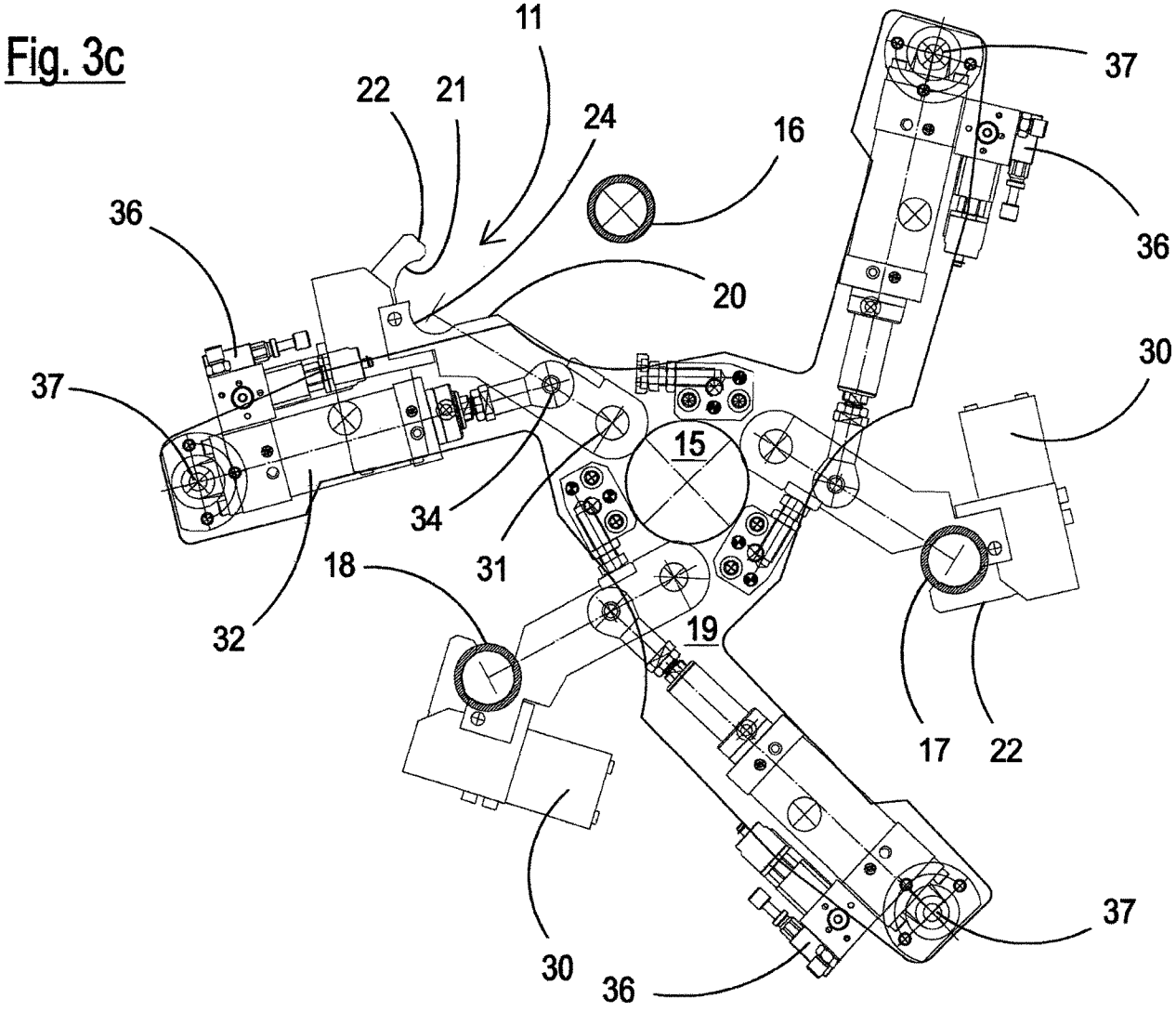
Figure 4A:
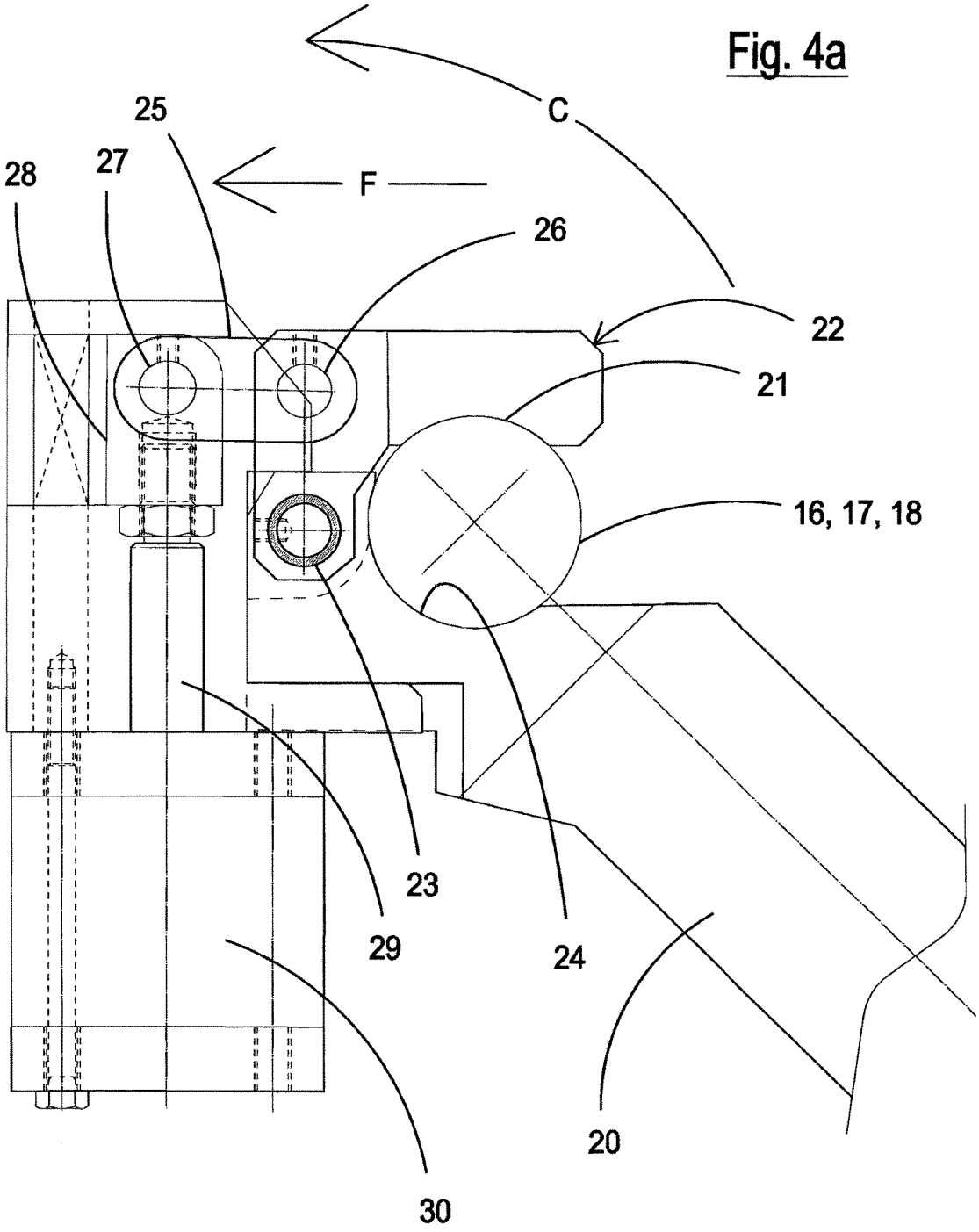
Figure 4B:
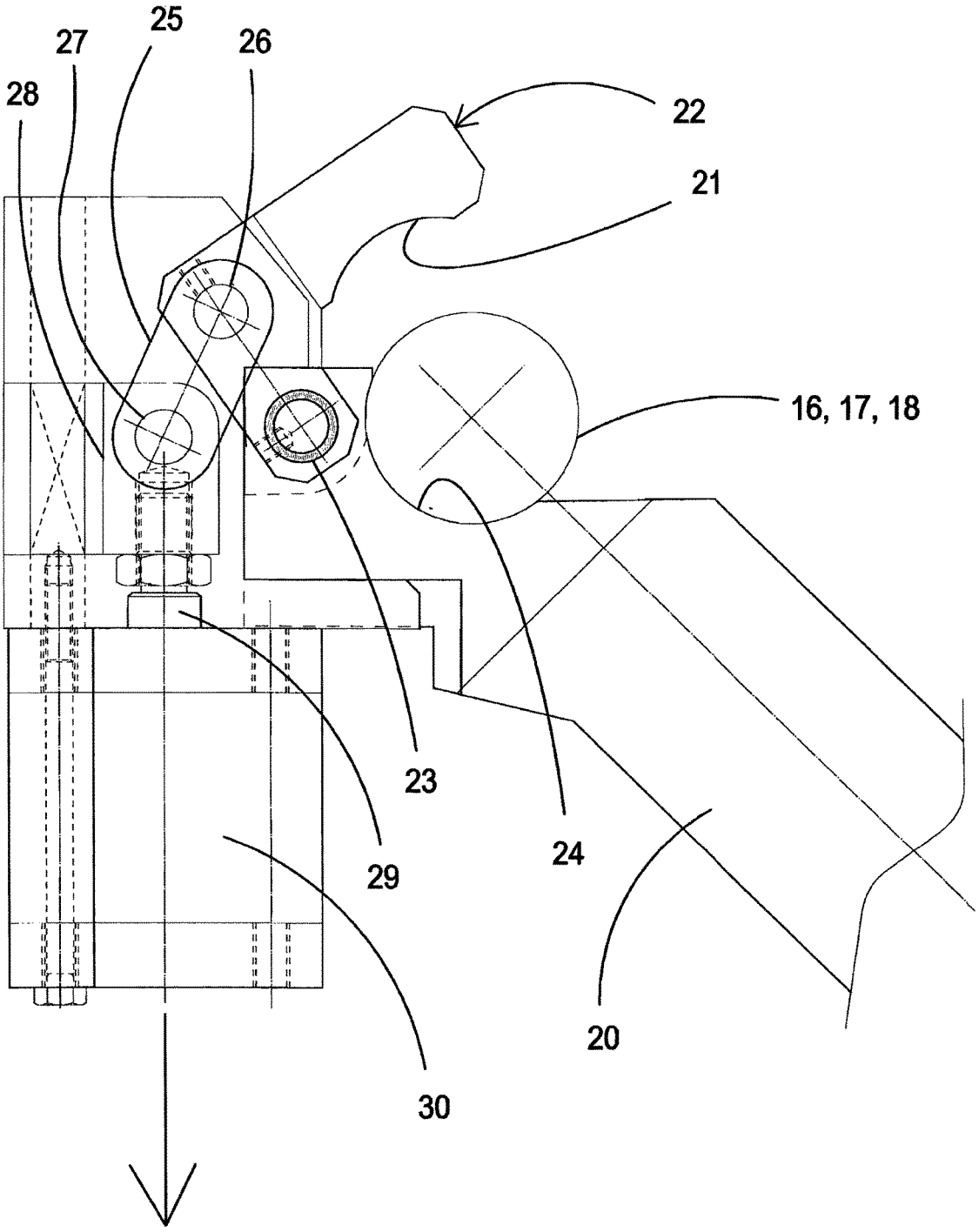

FIGS. 3*a*, 3*b* and 3*c* are schematic views of the functioning of the group of the invention in different consecutive operative phases;

FIGS. 4*a* and 4*b* are enlarged partial front views of holding and supporting elements of the end of the spindle of the group of the invention in two different operative phases.

Figure 1:
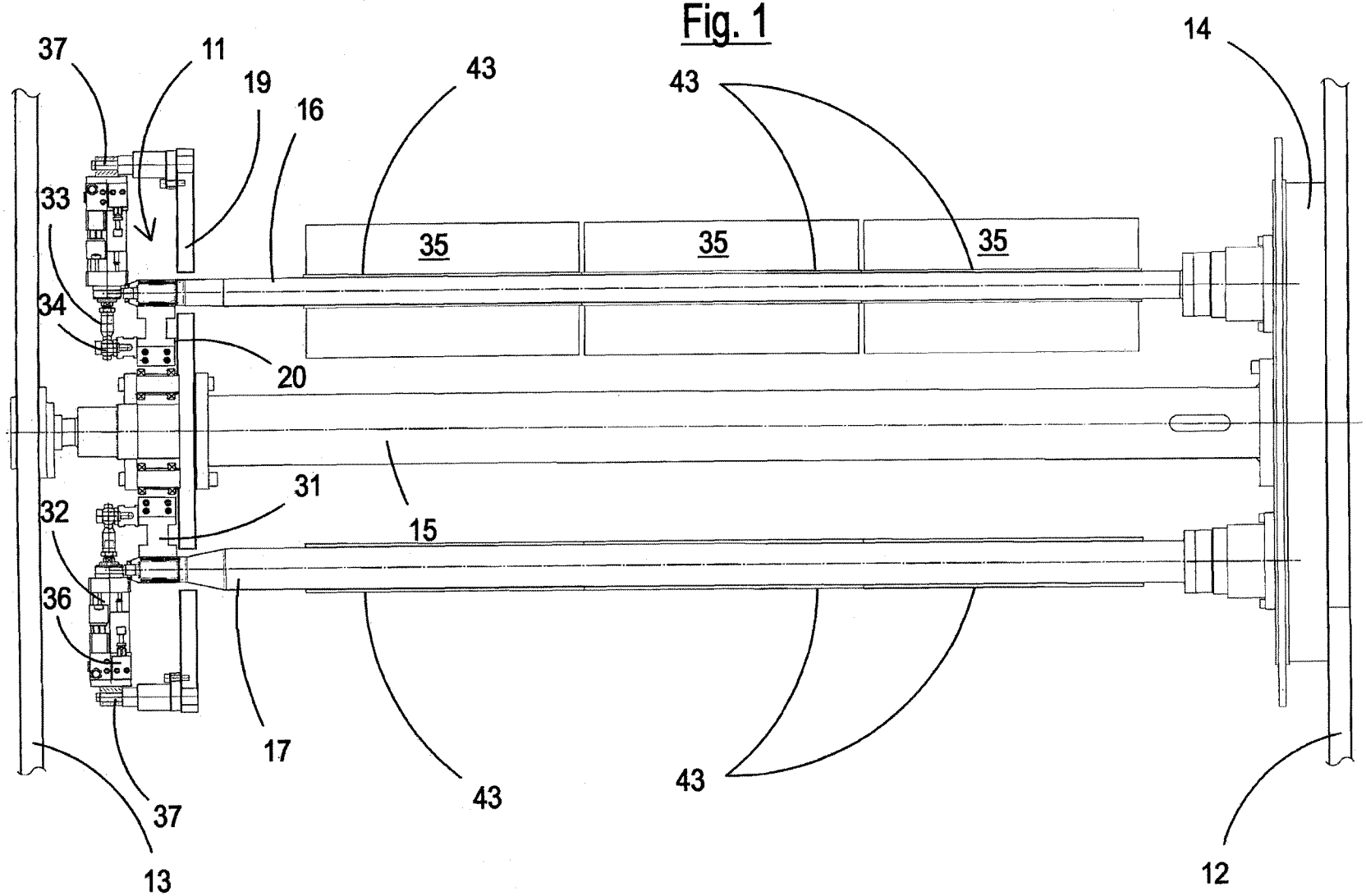
FIG. 1 is a raised schematic side view showing part of a winding machine which comprises a holding and supporting group of a winding spindle produced according to the invention.

With reference first of all to FIG. 1, this illustrates a raised schematic side view showing part of a winding machine in the area which comprises a holding and supporting group of a winding spindle 11 produced according to the invention.

The holding and supporting group 11 is positioned inside two vertical uprights 12, 13 which form the shoulders of the winding machine. A first upright 12 cantilever carries, on a rotating supporting plate 14, a central shaft 15, supported at the other end in correspondence with the second upright 13.

The plate 14, rotating around the central shaft 15, also carries three spindles, 16, 17 and 18, arranged at 120° with respect to each other, which complete the winding reel.

According to the invention, the holding and supporting group of a winding spindle 11 produced according to the invention, is associated with the reel.

The group 11 comprises a star 19 or shaped plate with three selective supporting arms of the free end of the three spindles 16, 17 and 18. More specifically, the grip of the single spindle in correspondence with each end of the three spindles 16, 17 or 18 is effected by a respective toggle lever mechanism.

Said toggle lever mechanism is driven by an actuator 30 and is carried on a lever 20 in turn caused to oscillate between an operative position and a rest position. The lever 20 can in fact be moved between an operative blocking position of the respective spindle 16, 17 or 18 and a rest position for releasing the respective spindle 16, 17 or 18 by means of a further actuator 32.

The toggle lever mechanism comprises a jaw 21 consisting of a bellcrank or toggle lever 22 hinged by means of a pin 23 to an upper end of the lever 20. The lever 20 also comprises, close to said pin 23, a housing 24 having a complementary form with respect to the jaw 21 creating a seat for the end of the single spindle 16, 17 or 18.

A biscuit 25 is connected at a first end by means of a pin 26 to an intermediate portion of the bellcrank 22 and at a second end by means of a pin 27 to a loop 28 integral with a stem 29 of the actuator 30, consisting of a pneumatic cylinder, arranged integrally with the lever 20.

The lever 20 is, in turn, hinged, by means of a pin 31, at an opposite end to that carrying the jaw 21, to the star-shaped plate 19. The lever 20 is caused to oscillate around said pin 31 by means of the further actuator 32, such as a pneumatic cylinder. The actuator 32 is hinged at a first end, by means of a pin 37, on an arm of the star-shaped plate 19, and one of its stems 33, at a free end, is connected through a pin 34 to the lever 20.

In particular, FIGS. 3*a*, 3*b* and 3*c* are schematic views of the functioning of the group of the invention in different consecutive operative phases.

An extremely secure and reliable holding "system" of the single spindle 16, 17 or 18 is therefore produced, which also minimizes the stoppage times.

The necessity of effecting very rapid change cycles with the group of the invention, in fact, allows spools 35 (of which three are shown in FIG. 1) produced by the reel, to be extracted without moving the same. According to the invention, in fact, this operation can only be effected by freeing an end of the spindle of the reel in question, to allow the spools 35 produced to be extracted.

The movable gripping "system" of an end of the spindle 16, 17 or 18 of the reel allows this operation to be effected and at the same time ensures a firm hold (wedge-insertion) during the winding phase. All the vibrational phenomena typical of the unstable or resting systems so far adopted are therefore eliminated.

FIGS. 3*a*-3*c* and 4*a*-4*b* show the functioning of a group according to the invention, which can be summarized as follows.

FIGS. 3*a* and 4*a* show how, under a normal winding condition of the spools 35, the pneumatic cylinder 30 drives the lever 22 with the relative jaw 21 of the toggle lever mechanism to be re-closed on the free end of the spindle 16, as for all the other spindles 17 and 18. For the sake of simplicity, mention will now be made of the spindle 16 alone. Said end of the spindle 16, moreover, is housed in the seat 24 of the lever 20. This guarantees the stable tightening of the spindle 16. In a preferred embodiment, in order to completely eliminate the risk of disengagement, an irreversibility of the toggle lever mechanism is envisaged. It should in fact be noted that, in a blocking position of the toggle lever mechanism, the pins 26, 27 of the biscuit 25 are aligned so as to be, on the one hand, in an aligned position with the jaw 21 and, on the other hand, perpendicular to the stem 29 of the actuator 30. The stable tightening of the spindle 16, 17 and 18 of interest is thus created and the risk of disengagement is completely eliminated thanks to the irreversibility of this position. It is in fact impossible for the elements collaborating with each other, the bellcrank 22 and lever 20, to move with respect to each other, even accidentally, as also the respective jaw 21 and housing 24.

It should also be pointed out that the lever 20 is angularly arranged so as to be close to the positioning axis of the spindle 16 or other spindle of interest. For this purpose, the angular position of the lever 20 is guaranteed by the extension of the stem 33 of the pneumatic cylinder 32, and its blockage is effected by means of a specific hydraulic brake 36, which exploits the incompressibility of the oil contained therein to guarantee its absolute immobility and stability of position.

FIG. 3*b* shows a preliminary position to the extraction phase of the spools 35, in which the pneumatic cylinder 30 effects the opening of the bellcrank or toggle lever mechanism 22.

The pneumatic cylinder 32 withdraws its stem 33 and exerts a return movement on the lever 20 in an anticlockwise direction so as to create space for the passage of the spools produced 35 which can be discharged.

Once empty cores 43 have been charged onto the spindle of interest, the closing procedure is obviously the exact contrary.

A group according to the present invention defines a situation of double wedge-insertion for the spindles of the winding reels, equalizing any possible flexions created by the force of possible contact rolls (not shown) and consequently balancing the peripheral velocities of the two ends of the same spindle.

Figure 2:
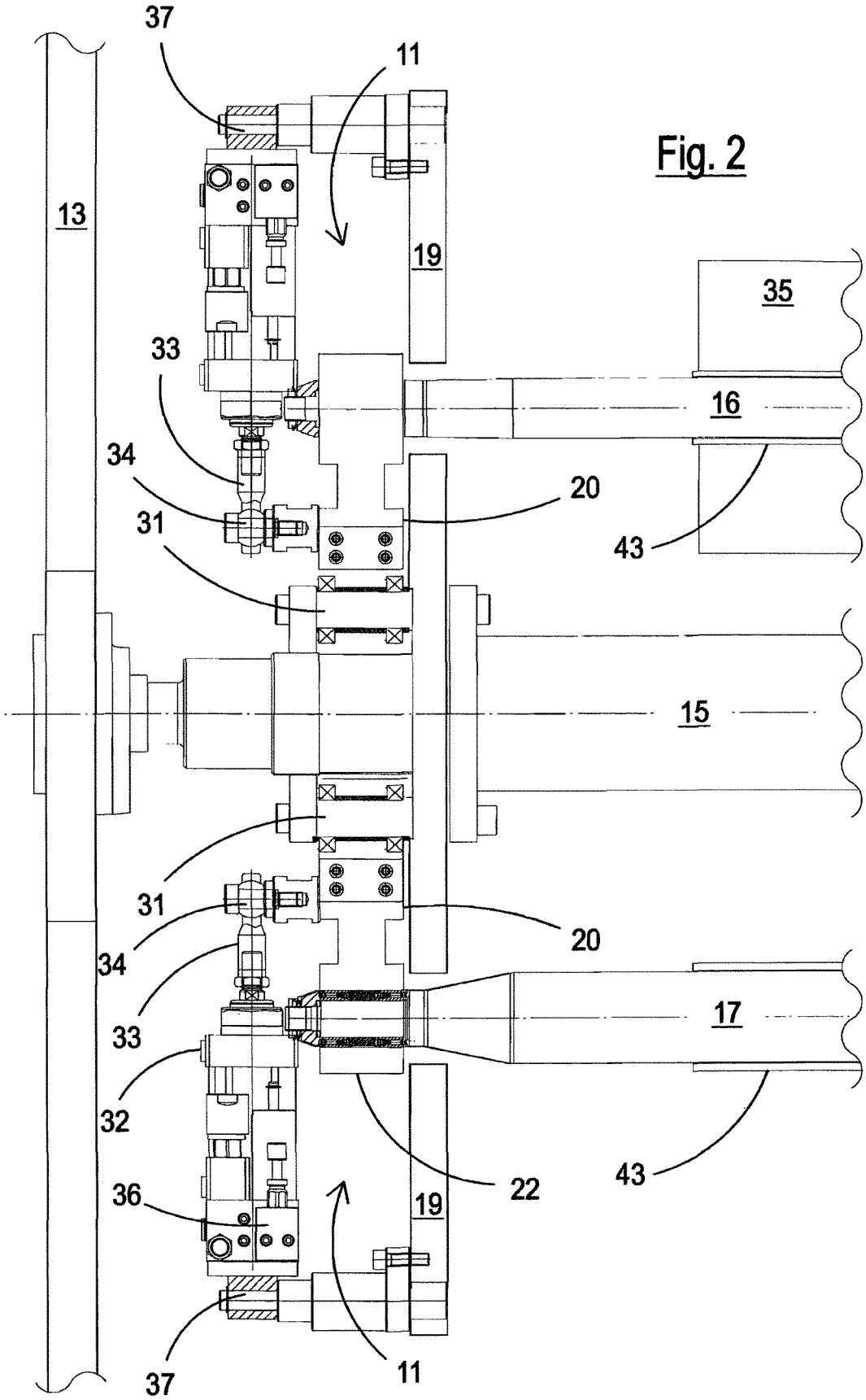
FIG. 2 is an enlarged view of some of the parts of FIG. 1, partially sectioned for a clearer understanding.

FIG. 2 clearly shows the wedge-insertion condition guaranteed by the toggle lever mechanism 22 on the end of the spindle 16 of the reel that must be freed when the spools 35 are discharged. The extreme proximity of the jawed seat 21 of the toggle lever mechanism 22 with respect to the winding area of the film, ensures a significant wedge-insertion effect. The free inflection length is reduced and above all, the symmetry of the behaviour of the spindle of the reel along the whole length is guaranteed.

For a better understanding, FIGS. 4*a* and 4*b* illustrate the main functioning phases of the toggle lever mechanism 22. When the stem 29 of the pneumatic cylinder 30 is in an extracted position, the opening torque C of the jaw 21 is theoretically infinite, as it has to overcome a force F which is expressed along its own rotation axis.

Only the re-entry movement of the stem 29 of the pneumatic cylinder 32 (FIG. 4*b*) can "free" said jaw 21, allowing its rotation around its fulcrum or pin 23.

With the present invention, a movable tightening "system" of an end of the spindle 16, 17 or 18 of the reel is created, which allows a rapid and stable operating position and an equally rapid removal of the spools. At the same time, a firm hold (wedge-insertion) is guaranteed during the winding phase, thus eliminating vibrational phenomena typical of the known unstable or resting systems, such as for example tip-tailstock end supporting groups.

A holding and supporting group of a winding spindle in a machine for winding plastic film onto spools is also created according to the invention, which ensures a firm supporting and blockage in the spindle, together with its rapid possibility of removal.

The objective mentioned in the preamble of the description has therefore been achieved.

The forms of the structure for producing a group of the invention, as also the materials and assembly modes, can obviously differ from those shown for purely illustrative and non-limiting purposes in the drawings.

The protection scope of the invention is therefore delimited by the enclosed claims.

The invention claimed is:

1. A holding and supporting group of a winding spindle in a machine for winding plastic film onto spools, comprising:

a winding reel positioned between a first and a second upright (12,13), wherein the first upright (12) carries a rotating plate (14) which cantilever-supports three spindles (16,17,18) and a central shaft (15), wherein said central shaft (15) is supported at an opposite end by the second upright (13), and wherein, at one end of said central shaft (15), there is a star-shaped plate (19) with three supporting arms for each free end of the three spindles (16,17,18) through a respective toggle lever mechanism (21,22,25) driven by an actuator (30) carried on a lever (20) articulated with said star-shaped plate (19), said lever being caused to oscillate between an operative blocking position of the respective spindle (16,17 or 18) and a rest position for releasing the respective spindle (16,17,18) by a second actuator (32).

2. The holding and supporting group according to claim 1, wherein said toggle lever mechanism comprises a jaw (21) having a bellcrank (22) hinged by a pin (23) to an upper end of the lever (20), and wherein said lever (20) comprises, in proximity of said pin (23), a housing (24) having a complementary form with respect to the jaw (21) creating a seat for the free end of a single spindle (16, 17 or 18).

3. The holding and supporting group according to claim 2, further comprising a biscuit (25), connected at a first end by a pin (26) to an intermediate portion of the bellcrank (22) and at a second end by a pin (27) to a loop (28) integral with a stem (29) of said actuator (30).

4. The holding and supporting group according to claim 3, wherein, in the blocking position of said toggle lever mechanism, said pins (26,27) of said biscuit (25) are aligned in position with said jaw (21) and in a perpendicular position with respect to said stem (29) of said actuator (30), causing a stable tightening of the spindle (16 or 17 or 18) and completely eliminating a risk of disengagement due to irreversibility of position.

5. The holding and supporting group according to claim 1, wherein said lever (20) is hinged by a pin (31) at an opposite end to an end carrying said jaw (21) to the star-shaped plate (19), and wherein the second actuator (32) is carried on an arm of said star-shaped plate (19) and a stem (33) thereof, at a free end, is connected through a pin (34) to said lever (20).

6. The holding and supporting group according to claim 1, further comprising a brake (36) adapted to block an angular position of the lever (20) and associated with said lever (20).

* * * * *